United States Patent [19]

Lobell

[11] 4,126,966

[45] Nov. 28, 1978

[54] WEATHERSTRIP TAPE

[76] Inventor: Jewel M. Lobell, 12230 Hubbell, Detroit, Mich. 48227

[21] Appl. No.: 882,787

[22] Filed: Mar. 2, 1978

[51] Int. Cl.[2] ..... E06B 7/16

[52] U.S. Cl. ..... 49/489; 49/475; 49/485; 428/78; 428/81; 428/124; 428/130; 428/189; 428/315

[58] Field of Search ..... 428/77-81, 428/124,83, 126-129, 130, 156, 158-160, 189-194, 310, 315; 49/485, 489, 475

[56] References Cited

U.S. PATENT DOCUMENTS

| | | | |
|---|---|---|---|
| 2,327,580 | 8/1943 | Carney | 49/489 |
| 3,271,232 | 9/1966 | Moore | 428/130 |
| 3,624,964 | 12/1971 | Bordner et al. | 49/489 |
| 3,840,266 | 10/1974 | Carlson | 428/122 |

*Primary Examiner*—William J. Van Balen
*Attorney, Agent, or Firm*—Cullen, Sloman, Cantor, Grauer, Scott, & Rutherford

[57] ABSTRACT

A weatherstrip tape includes an elongated body of resilient plastic foam material rectangular in cross section and having a pair of opposed faces. A pair of longitudinally extending parallel coplaner anchor strips of plastic material along their inner edge portions overly one face of said body and are secured thereto. Outer edge portions of said anchor strips extend laterally from opposite sides of said body. Said anchor strips are adapted for manual folding into parallel engagement, with said outer edge portions adapted for projection into and anchoring within a clearance space with the elongated body adapted for sealing over such clearance space.

5 Claims, 11 Drawing Figures

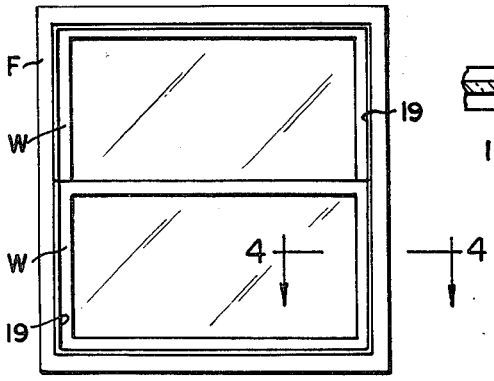
FIG. 3
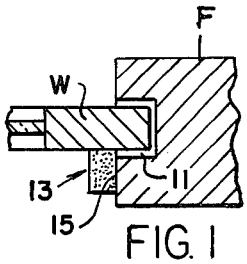
FIG. 1
PRIOR ART
FIG. 2
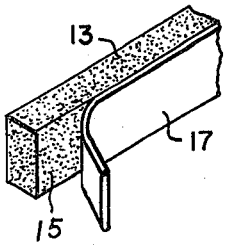
FIG. 5
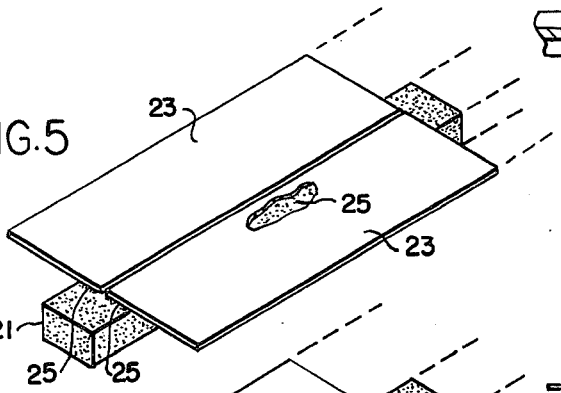
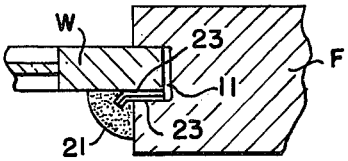
FIG. 4
FIG. 6
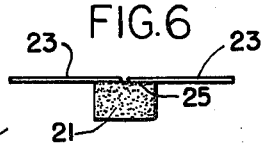
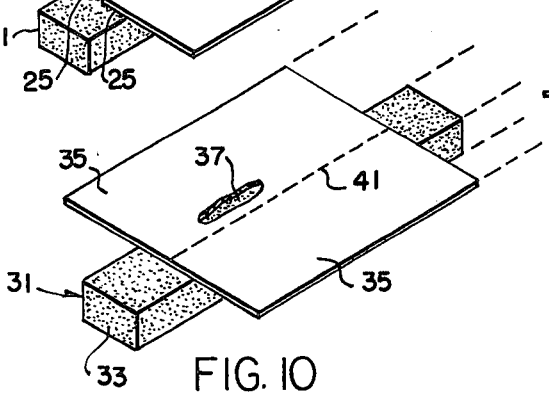
FIG. 10
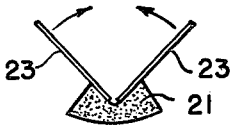
FIG. 7
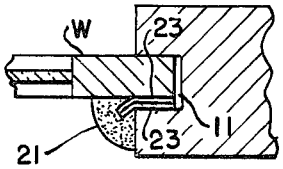
FIG. 9
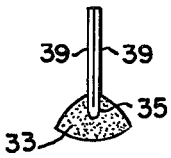
FIG. 11
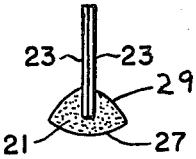
FIG. 8

WEATHERSTRIP TAPE

BACKGROUND OF THE INVENTION

Heretofore, weatherstripping tape has been provided of a foam plastic material and having a layer of pressure-sensitive adhesive upon one face thereof normally covered by a tear-off protective strip. Upon removal of said protective strip, the weatherstrip tape is applied to and over a clearance space between a pair of elements such as a window and its frame for sealing such clearance space.

The disadvantage of this construction is that it requires the use of a pressure-sensitive adhesive as the means for anchoring the weatherstripping to one of a pair of adjacent members for sealing a clearance space therebetween.

A further disadvantage of this type of weatherstrip tape is that upon removal thereof, it causes removal of considerable of the paint upon the surface to which the adhesive was previously applied.

A further disadvantage is that the weatherstrip tape is not reusable once it has been removed from its sealing position.

SUMMARY OF THE INVENTION

The present invention provides an improved weatherstrip tape which is self-securing and which does not require the use of adhesive for the purpose of anchoring the tape in a sealing position over a clearance opening between a pair of assembled parts.

It is an object of the present invention to provide an improved weatherstripping tape which may be automatically anchored to and over a clearance space between a pair of members without the use of any adhesive. Accordingly, the present weatherstrip tape is removable without damage to the underlying surface and is reusable.

It is another object to provide an improved weatherstripping tape which includes an elongated body of resilient plastic foam material to one face of which has been secured a pair of elongated anchor strips of plastic material and which project laterally of the body from its opposite sides with outer edge portions of the anchor strips adapted for folding into parallel engagement and with the outer edge portions adapted for projection into and anchoring within a clearance space and for holding the elongated body so as to cooperatively seal over said clearance space.

It is another object to provide an improved weatherstrip tape which has the ecological function that it is reusable and need not be discarded after each use.

These and other objects will be seen from the following specification and claims in conjunction with the appended drawing.

THE DRAWING

FIG. 1 is a fragmentary section illustrating the use of a prior art weatherstrip tape of rectangular cross section.

FIG. 2 is a fragmentary perspective view of such tape with its protective covering strip partially removed therefrom.

FIG. 3 is a front elevational view of a window within a frame and utilizing the present weatherstrip tape.

FIG. 4 is a fragmentary section taken in the direction of arrows 4—4 of FIG. 3, on a partially increased scale.

FIG. 5 is a fragmentary perspective view of the present weatherstrip tape.

FIG. 6 is an end elevational view thereof.

FIG. 7 is a similar view of the tape with its anchor strips partly flexed towards each other.

FIG. 8 is a similar view with the weatherstrip tape anchor strips fully flexed into parallel-engaging relation.

FIG. 9 is a view similar to FIG. 4, but on a further increased scale and showing the assembly of the weatherstrip tape as flexed within a clearance space between a window and frame, fragmentarily shown.

FIG. 10 is a fragmentary perspective view similar to FIG. 5 of a modified weatherstrip tape.

FIG. 11 is a view similar to FIG. 8, showing the full flexing of the anchor strip of FIG. 10 adapted for use the same as is shown in FIG. 9.

It will be understood that the above drawing illustrates merely a preferred embodiment of the invention, and that other embodiments are contemplated within the scope of the claims hereafter set forth.

DETAILED DESCRIPTION OF THE INVENTION

The present invention is directed to a weatherstrip tape made of a plastic foam material and represents an improvement over what has been done in the prior art. An example of the prior art is shown in FIGS. 1 and 2 of the drawings. Here with respect to a window frame F, fragmentarily shown, having a conventional channel 11, there is movably positioned therein a conventional window W. In normal constructions, in order to facilitate movement of the window relative to the frame, there is normally remaining after assembly a clearance space between the marginal edges of the window and the channel as well as the point where the window meets the sill through which some cold air may enter in the winter. For example, such clearance is shown at 11, FIG. 1. To close off this clearance opening between the window and the frame in the prior art, there has been provided an elongated strip of foam plastic material shown at 13, FIGS. 1 and 2, having a pressure-sensitive surface 15 upon one side thereof, normally protected by the tear-off strip 17, FIG. 2.

Upon removal of the tear-off strip 17 from the plastic foam strip, and being sure that the surface shown in FIG. 1 is perfectly clean, the tape is manually applied to the frame and at the same time, snugly against the edge of the window in order to bridge and close off the clearance space 11 to prevent drafts of cold air from entering the house in the wintertime. While the clearance opening has been defined as the space between a window and a frame, it is contemplated as equivalent that the clearance space could be between a door and its frame, a screen and its frame or a storm window, or with a clearance space often existing between peripheral portions of an air conditioner and the frame within which it is mounted and supported.

One disadvantage of the prior art weatherstripping 13 is that when it is stripped off, as in the summertime, it very often takes much of the paint from the frame with it.

Another disadvantage is that the strip is not reusable because the pressure-sensitive adhesive 15 has been fully utilized or has become dried out and cannot be reused.

As distinguished from the prior art, schematically shown in FIGS. 1 and 2, the present improved weatherstrip tape is designated at 19, closing off the clearance space 11 such as normally exists between the movable window W and its adjacent frame F, as shown in FIG. 3.

As shown in FIG. 1, while the weatherstripping 13 in the prior art is shown applied to the frame, it could just as well be adhesively applied to a peripheral portion of the window, nevertheless, blocking and closing off the clearance aperture 11.

The present improved weatherstrip tape, which is normally provided in a roll of 15 to 20 feet, is shown fragmentarily in the perspective view, FIG. 5, on an increased scale with respect to FIG. 3.

The present weatherstrip tape comprises an elongated body 21 of a suitable foam plastic material such as polyurethane or any other open-cell plastic foam material. Said body has a pair of top and bottom faces spaced apart approximately one quarter inch, for example, and whose transverse width is three-eighths of an inch, for example. A pair of longitudinally extending parallel coplanar anchor strips 23 overly one of the faces of said body and are suitably secured thereto. Said strips are of a thin plastic material such as polystyrene or other plastic.

The anchor strips 23 have inner longitudinal edge portions which are spaced apart as shown in FIG. 5 overlying one face of said body and include oppositely directed laterally extending outer edge portions which extend laterally of said body as shown in FIGS. 5 and 6. The securing of the anchor strips 23 upon one face of said body may employ any suitable compatible adhesive such as a plastic adhesive applied as a layer between the overlapping portions of the strips 23 and the corresponding surface of the plastic foam body 21.

The layer of adhesive 25 is interposed between the strips 23 and the body provides a permanent bond along the length of the anchor strips for securing them to said body.

The arrangement of the anchor strips with the respective body is best illustrated in the end view, FIG. 6.

For use of the present weatherstrip tape, it is required that the anchor strips 23 be manually and transversely folded approximately 90°, as shown in FIGS. 7 and 8, until they are in opposing engaging registry as in FIG. 8. So arranged, the said weatherstrip tape is applied to the clearance space or channel 11 throughout the corresponding peripheral portions between the window and frame in the manner shown in FIGS. 4 and 11.

The anchor strips 23, as arranged in FIG. 8, are shoved or plugged into the clearance space 11 and are frictionally retained therein. Adjacent portions of the foam plastic body are deformed, such as shown in FIG. 11 and snugly and cooperatively bridge the clearance space, bearing against the frame F and the window W.

Since the foam material is resilient in character, when unassembled with respect to the clearance opening, it will take the position shown in FIG. 6.

Accordingly, when the anchor strips 23 are manually flexed transversely to the parallel-engaging position shown in FIG. 8 and projected into the clearance aperture, FIG. 9, they are frictionally anchored therein so that the body of the seal 21 as deformed snugly bridges the clearance opening 11 and cooperatively engages adjacent surfaces of the window and frame, for illustration.

Accordingly, the present weatherstrip tape, when precut to the proper length, may be flexed as above described and the anchor strips 23 are manually projected within the clearance aperture 11 to serve as a sole anchoring means for said weatherstrip tape.

No adhesive is required for anchoring the weatherstrip as shown in FIG. 9 and, accordingly, the present weatherstrip tape may be easily removed without damaging paint and may be reused. This is a further ecological reason which demonstrates an improvement of the present weatherstrip tape over the prior art.

As the anchor strips 23 are rotated from the planer position shown in FIG. 6 to the position shown in FIG. 7 to the position shown in FIG. 8 in parallel engagement for insertion within the clearance opening, the outer surface of the anchor strip is no longer flat but is arcuate, as shown at 27, FIG. 8, and includes further the pair of opposed arcuate inner body surfaces 29. It is these arcuate surfaces 29 which bridge the clearance space 11 and at the same time, cooperatively nest against adjacent surface portions of the window and frame.

As above described with reference to the clearance opening, it is contemplated as a part of the invention that the present weatherstrip tape can apply to any type of clearance opening for closing off a draft therethrough, whether it be a window or door or screen or storm window of an air conditioner frame or the like.

MODIFICATION

A modification of the present weatherstrip tape as shown at 31 in FIG. 10 in the form it would take when it has been cut off as a part of a long roll.

In the modification, there is provided an elongated plastic foam body 33, rectangular in cross section, as was the foam body 21, and overlying said foam body and secured thereto is a unitary plastic anchor strip 35. A layer of a suitable plastic adhesive is shown at 37 interposed between the overlying portions of the anchor strip 35 and the one face of the plastic foam body 33. The layer of adhesive 37 for securing the single anchor stip 35 to the body, corresponds to the layer of adhesive 25 interposed between the anchor strips 23 and body 21 of FIG. 5.

For use of the modified weatherstrip tape of FIG. 10, the edge portions of the anchor strips are manually grasped and folded transversely to take the form shown in FIG. 11. Here the opposed engaging anchor strip members 39 function the same as the anchor strips 23 and are adapted for projection into the clearance opening 11 between and adjacent window and frame in the same manner as shown in FIG. 9.

The unitary anchor strip 35 may be longitudinally scored along the line 41 along the median thereof to facilitate manual flexing of the unitary anchor strip from the shape shown in FIG. 10 to the shape shown in FIG. 11. Again the elongated foam plastic body has changed from the rectangular cross sectional shape of FIG. 10 to provide the arcuate surfaces shown corresponding to surfaces 27 and 29 of FIG. 8.

In addition to the resiliency built into the resilient plastic foam body 33, there is an additional resiliency of the unitary plastic anchor strip 35 which would normally tend to flex the anchor strip members 39 outwardly such as to the position shown in FIG. 6. Thus, with this modification, there is believed to be a slightly increased frictional holding power of the anchor strip members with respect to the clearance opening 11 if used in the environment as shown in FIG. 9.

While certain dimensions were given, for example, with respect to the anchor strip shown in FIG. 6, this was only for illustration, it being contemplated that the dimensions can be changed as desired. For example, in the illustrated embodiment, the widths of the anchor strips 23 are three-quarters of an inch, approximately. In some areas where the clearance channel 11 may be of less depth and it would be necessary to provide anchor strips of less width or to manually trim them so that they will permit full insertion thereof into the clearance opening until the deformed body 21 snugly bears against the adjacent clearance opening and the corresponding frame and window, as shown in FIG. 9 or FIG. 4.

The present weatherstrip tape is reusable and in use is cut to the desired length before plugging into the clearance apertures described for closing off drafts and resulting in the saving of energy. The present weatherstrip tape will not damage paint around windows. In use all that is needed is the manual folding of the anchor strips and the plugging of said folded strips into the clearance opening a sufficient distance that the deformed foam plastic body bridges the clearance opening and at the same time, cooperatively bears against the adjacent movable parts, such as the window and frame shown.

Having described my invention, reference should now be had to the following claims.

I claim:

1. A weatherstrip tape comprising an elongated body of resilient foam plastic material, rectangular in cross section and having a pair of opposed faces;

a pair of longitudinally extending parallel coplanar anchor strips of plastic material having inner longitudinal edge portions overlying one face of said body and secured thereto, and having outer edge portions extending laterally from opposite sides of the said body respectively;

the securing of said strips to said body including an adhesive layer interconnecting overlapping contacting surfaces of said anchor strips and body.

2. In the weatherstrip of claim 1, the inner edges of said anchor strip being spaced apart.

3. In the weatherstrip of claim 1, said anchor strips being adapted for manual folding into parallel engagement, with said outer edge portions adapted for projection into and anchoring within a clearance space, said elongated body adapted to seal over said clearance space.

4. In the weatherstrip of claim 3, said folding of said anchor strips distorting the cross section of said body biasing said strips outwardly under tension for frictional anchoring of said strips.

5. In combination, the weatherstrip tape of claim 1, a window frame having an internal channel and a window movably nested within said channel and frame;

there being a peripheral clearance space between said window and frame;

said strips folded into parallel engagement, with said outer edge portions in secured frictional projection into said clearance space;

said body snugly engaging said window and frame and bridging over said clearance space.

* * * * *